US007471138B1

(12) United States Patent
Shen

(10) Patent No.: US 7,471,138 B1
(45) Date of Patent: Dec. 30, 2008

(54) DC OUTPUT VOLTAGE CIRCUIT WITH SUBSTANTIALLY FLAT PSRR

(75) Inventor: Guangping Shen, Palo Alto, CA (US)

(73) Assignee: Altera Corporation, San Jose, CA (US)

( * ) Notice: Subject to any disclaimer, the term of this patent is extended or adjusted under 35 U.S.C. 154(b) by 78 days.

(21) Appl. No.: 11/431,340

(22) Filed: May 9, 2006

(51) Int. Cl.
*G05F 1/10* (2006.01)
*G05F 3/08* (2006.01)

(52) U.S. Cl. ..... 327/541; 323/312; 327/539

(58) Field of Classification Search ..... 323/226, 323/281, 303, 311, 312, 273, 304; 363/95, 363/97, 98, 131, 132; 315/209 R, 219; 307/24, 307/31, 33, 34, 60, 82; 327/539, 540, 541, 327/543

See application file for complete search history.

(56) References Cited

U.S. PATENT DOCUMENTS 5,614,815 A * 3/1997 Yamagata et al. ..... 323/313
5,847,949 A * 12/1998 Jiang ..... 363/65
6,414,512 B1 * 7/2002 Moyer ..... 326/30
6,639,452 B2 * 10/2003 Ono et al. ..... 327/541
6,876,251 B2 * 4/2005 Watanabe ..... 327/541
6,956,426 B2 * 10/2005 Wodnicki ..... 327/382
6,975,164 B1 * 12/2005 Matsui et al. ..... 327/541
7,049,796 B2 * 5/2006 Cherniski et al. ..... 323/271
7,071,582 B2 * 7/2006 Sae-Ueng et al. ..... 307/83
7,148,668 B1 * 12/2006 Collins ..... 323/282
2004/0218319 A1 * 11/2004 Sae-Ueng et al. ..... 361/18

* cited by examiner

*Primary Examiner*—Jessica Han
*Assistant Examiner*—Emily Pham
(74) *Attorney, Agent, or Firm*—Ropes & Gray LLP

(57) ABSTRACT

The disclosed technology provides circuitry for providing a DC output voltage. In accordance with one aspect of the invention, the circuit includes a power connection and a transistor connected to the power connection. A current source coupled to the transistor causes the transistor to pass at least a minimum current. The transistor's gate-to-source voltage can vary based on the current that passes through it, so that the minimum current established by the current source corresponds to a particular gate-to-source voltage. A reference voltage circuit is coupled to the transistor and causes a substantially constant voltage to appear on the gate connection of the transistor. The transistor's source connection carries an output voltage that is based on the gate voltage and the transistor's gate-to-source voltage. In accordance with one aspect of the invention, the DC output voltage circuitry has a substantially flat PSRR across frequencies of interest.

20 Claims, 3 Drawing Sheets

DC OUTPUT VOLTAGE CIRCUIT WITH SUBSTANTIALLY FLAT PSRR

BACKGROUND OF THE INVENTION

This invention relates to circuitry for providing a DC output voltage, and, more particularly, to DC output voltage circuitry that has a substantially flat power supply rejection ratio across a frequency range of interest.

Electrical power in the form of voltage and current drives almost all modern day electronics. Two familiar sources of electrical power are the battery and the electrical power delivered to wall outlets. These are generally the only sources of electrical power that are ubiquitously available to consumers. Therefore, nearly all manufacturers of consumer electronics design their products to be powered by these sources.

Batteries and wall outlets provide electrical power in predetermined formats. Specifically, batteries provide a substantially constant voltage and uni-directional current. In contrast, wall outlets provide a periodic voltage and bi-directional current. However, electronic devices often require voltages and currents in different formats and levels than those available from a battery or wall outlet. An entire field of study, called power electronics, is devoted to the study of power and ways for providing voltage and current in different levels and formats.

One category of power electronic circuits is configured to produce a "DC voltage," which is used herein to refer to a substantially constant voltage signal. The term "DC output voltage circuit" will be used herein to refer to a circuit that operates to provide a DC output voltage, when the operating conditions allow it to do so. In operation, a DC output voltage circuit may have some sensitivity to operating conditions (e.g., temperature), such that variations in the conditions may alter the value of the circuit's output voltage. Additionally, other circuits coupled to the DC output voltage circuit may introduce, for example, switching noise or frequency components into the DC output voltage circuit. Under consistent operating conditions and in the absence of frequency coupling, however, a DC output voltage circuit, as used herein, provides a substantially constant DC output voltage.

A DC output voltage circuit generally includes a power connection and an output connection. The DC output voltage circuit receives some voltage and current on the power connection and attempts to provide a DC voltage on the output connection. In some cases, a DC output voltage circuit can be designed in a way that mitigates or prevents voltage variations on the power connection from affecting the DC voltage on the output connection. One common way of quantifying this capability is by using a measure called the "power supply rejection ratio," or PSRR, which is commonly measured in decibels. PSRR is a ratio of change in voltage on the power connection to a corresponding change in voltage on the output connection. A DC output voltage circuit that is more effective at mitigating the effects of the power connection's variations will have a higher PSRR. A DC output voltage circuit that is less effective at mitigating the effects of the power connection's variations will have a lower PSRR.

One existing method for designing a DC output voltage circuit includes using a negative feedback loop that compares the output voltage with a reference voltage. If the output voltage is greater than the reference voltage, the feedback loop operates to decrease the output voltage. If the output voltage is less than the reference voltage, the feedback loop operates to increase the output voltage. However, such designs almost always include an amplifier in the feedback loop, and it is known that amplifiers have poor PSRR for higher-frequency variations on the power connection. Therefore, DC output voltage circuits that use feedback may perform poorly in circumstances that involve high frequency noise on the power connection, for example. Another existing method for designing a DC output voltage circuit includes using what is known as a "diode-connected source follower," which uses diodes connected to the gate of a transistor to set the DC output voltage. However, it is known that such circuits have poor PSRR for lower-frequency variations on the power connection. Therefore, DC output voltage circuits that use a diode-connected source follower may perform poorly in circumstances that involve low-frequency noise on the power connection, for example.

In the circuit implementations above, the deficiencies in the PSRR may cause variations in the DC output voltage in certain circumstances. Accordingly, these circuits may not be suitable for certain applications. At the same time, technology is increasingly progressing towards multipurpose devices and platforms that support diverse functionality, modes, and features. Most likely, these multipurpose platforms and devices will use different voltages and currents and will require the use of a DC output voltage circuit. However, for at least the reasons above, existing DC output voltage circuits may be incapable of accommodating at least some of these different applications. Accordingly, there is continued interest in improving the technology of DC output voltage circuitry at least from the point of view of greater applicability.

SUMMARY OF THE INVENTION

The disclosed technology provides circuitry that provides a DC output voltage. In accordance with one aspect of the invention, the circuitry includes a power connection and a transistor connected to the power connection. The transistor is also coupled to a current source that causes the transistor to pass at least a minimum current. The transistor's gate-to-source voltage can vary based on the current that passes through it, so that the minimum current established by the current source corresponds to a particular gate-to-source voltage. A reference voltage circuit is coupled to the transistor and causes a substantially constant voltage to appear on the gate connection of the transistor. The transistor's source connection carries an output voltage that is based on the gate voltage and the transistor's gate-to-source voltage. In accordance with one aspect of the invention, the circuit has substantially flat power supply rejection ratio across frequencies of interest.

Further features of the invention, its nature and various advantages, will be more apparent from the accompanying drawings and the following detailed description.

DETAILED DESCRIPTION

The disclosed technology provides circuitry for providing a DC output voltage. As mentioned above, the term "DC voltage" is used herein to refer to a substantially constant voltage signal. The term "DC output voltage circuit" is used herein to refer to a circuit that operates to provide a DC output voltage, when operating conditions or noise/signal coupling allow it to do so. Under consistent operating conditions and in the absence of frequency coupling, however, a DC output voltage circuit, as used herein, provides a substantially constant DC output voltage.

Figure 1:
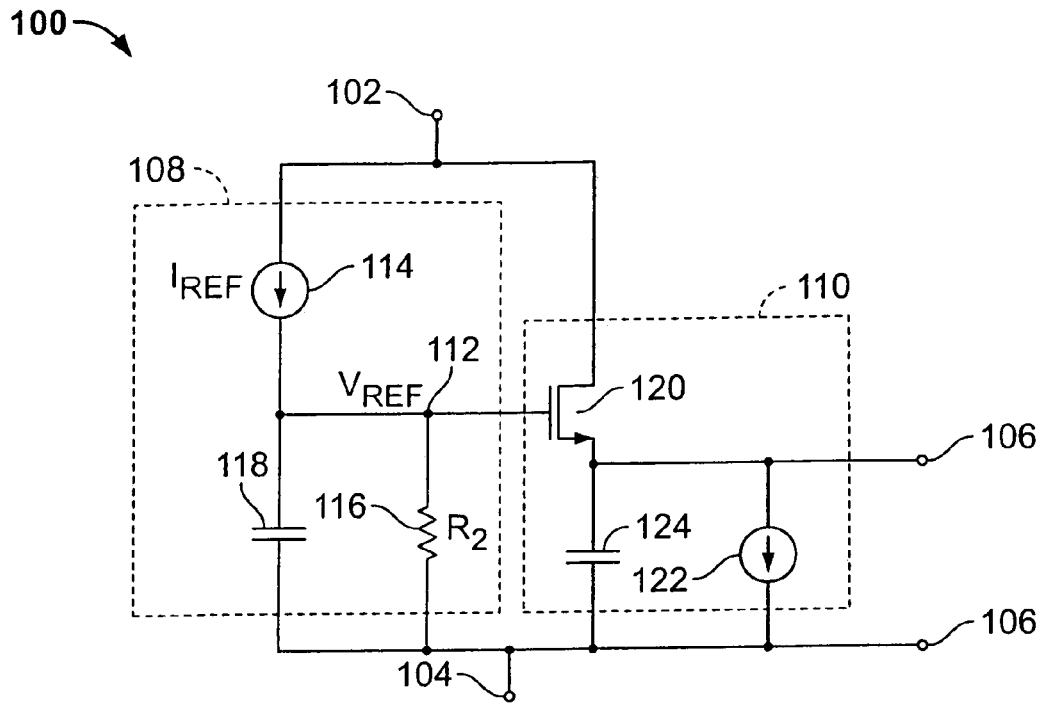
FIG. 1 is a circuit diagram of an exemplary DC output voltage circuit in accordance with an aspect of the invention.

Referring to FIG. 1, there is shown a DC output voltage circuit 100 in accordance with one aspect of the invention. The circuit 100 includes power connections 102, 104, which couple an input voltage (not shown) to the circuit 100. Additionally, the top power connection 102 in the illustration allows an incoming current to flow into the circuit 100, and the bottom power connection 104 allows an outgoing current to flow out of the circuit 100. In one embodiment, the input voltage can be a DC input voltage provided by a battery or another power electronics circuit, such as an AC-to-DC converter (not shown). The circuit 100 also includes output connections 106 for coupling an output voltage to another circuit. For convenience, the description that follow will refer to a connection and a voltage on the connection using the same reference numeral.

In accordance with one aspect of the invention, the circuit 100 operates to provide a DC output voltage on the output connections 106. The circuit 100 includes a reference voltage circuit 108 and an output stage 110. The reference voltage circuit 108 operates to provide a reference voltage 112 to the output stage 110. The output stage 110 provides the DC output voltage on the output connections 106 based on the reference voltage 112.

In the illustrated embodiment of FIG. 1, the reference voltage circuit 108 includes a current source 114 that provides a reference current $I_{REF}$, and a resistance $R_2$ 116. Optionally, the reference voltage circuit 108 can also include a capacitance 118 as shown. In can be seen that when the reference voltage circuit 108 has settled, the reference voltage 112 is determined by $V_{REF}=I_{REF}\cdot R_2$. In an embodiment without the capacitance 118, all of the reference current $I_{REF}$ flows through the resistance $R_2$, thereby producing the reference voltage $V_{REF}=I_{REF}\cdot R_2$. In an embodiment with the capacitance 118, the reference voltage 112 eventually settles to $V_{REF}=I_{REF}\cdot R_2$. Initially, however, the reference voltage starts at zero volts. The capacitance has the relationship $$i_C = C\cdot\frac{dv_C}{dt},$$

where C is the value of the capacitance in Farads, $i_C$ is the current flowing across the capacitance, and $v_C$ is the voltage across the capacitance. The capacitance 118 does not allow an instantaneous increase in the voltage $v_C$. Therefore, when the reference voltage circuit 108 initially begins operating, the reference voltage 112 is zero and none of the reference current $I_{REF}$ flows through the resistance 116. Therefore, initially, all of the reference current $I_{REF}$ flows through the capacitance 118, causing the reference voltage 112 to increase based on $$\frac{dv_C}{dt} = \frac{dv_{REF}}{dt} = \frac{I_{REF}}{C}.$$

As the reference voltage 112 increases, an increasing portion of the reference current begins to flow through the resistance $R_2$ 116. Eventually, all of the reference current transfers from the capacitance 118 to the resistance 116, and the reference voltage 112 settles to $V_{REF}=I_{REF}\cdot R_2$. At this point, the capacitance 118 has stored charge given by $q_C=C\cdot V_C=C\cdot I_{REF}\cdot R_2$.

One role of the capacitance can be to prevent the reference voltage 112 from changing suddenly. For example, if the reference current suddenly decreases for any reason, the capacitance 118 will not allow an instantaneous change in the reference voltage 112. The capacitor 118 and will discharge to provide a current $i_C$ to the resistance $R_2$ to maintain the value of the reference voltage 112 at the moment of the current source's 114 current decrease. Similarly, if the reference current suddenly increases for any reason, the amount of current in the sudden increase will initially flow through the capacitance 118 and will, afterwards, gradually transfer over to the resistance 116. As mentioned above, when the reference voltage circuit 108 settles, all of the reference current $I_{REF}$ will flow through the resistance 116, and the capacitance 118 will have stored charge. In this manner, the reference voltage circuit 108 provides a reference voltage 112 to the output stage 110.

Figure 4:
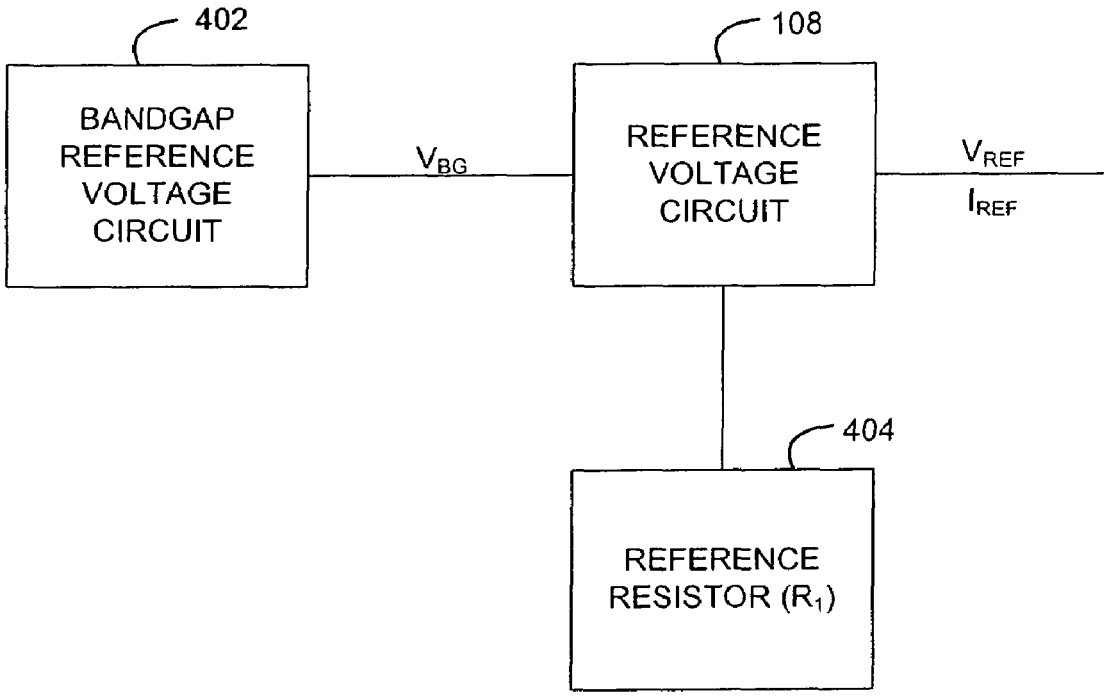
FIG. 4 is an exemplary block diagram of a reference voltage generation circuit in accordance with one aspect of the invention.

In accordance with one aspect of the invention, and as shown in FIG. 4, the current source 114 of the reference voltage circuit 108 can be implemented based on a bandgap voltage reference circuit 402. One skilled in the art will recognize that bandgap voltage reference circuit 402 provides a stable voltage that is relatively immune to temperature variations. Typically, bandgap voltage reference circuit 402 can produce a stable voltage by balancing the negative temperature coefficient of a pn junction with the positive temperature coefficient of a thermal voltage $$V_t = \frac{kT}{q},$$

where k is Boltzmann's constant, and T is temperature. In one embodiment, the current source 114 can provide a reference current based on a bandgap voltage $V_{BG}$ and a reference resistance $R_1$ 404. In particular, the reference current can be based on, or can be approximately equal to, $$I_{REF} = \frac{V_{BG}}{R_1}.$$

In one embodiment, this reference current can be implemented by a current mirror circuit (not shown). In one embodiment, the reference resistance $R_1$ and/or the resistance $R_2$ 116 can be variable resistances that can be configured to adjust the reference voltage 112. In one embodiment, the reference resistance $R_1$ and/or the resistance $R_2$ 116 can be implemented by networks of resistances and switches, where the switches can be programmably configured to adjust the reference voltage 112. In one embodiment, the reference resistance $R_1$ (not shown) in the current source 114 can be produced using the same fabrication process as the resistance $R_2$ 116. Both resistances can be monolithic resistances produced in an integrated circuit. In this manner, the same natural variations in the fabrication process apply to both $R_1$ and $R_2$. Because the reference voltage 112 is based on $$V_{BG}\left(\frac{R_2}{R_1}\right),$$

any common process variations in $R_1$ and $R_2$ will cancel out in the numerator and the denominator.

Referring now to the output stage 110 in FIG. 1, the illustrated output stage 110 includes a transistor 120 and a current source 122. Optionally, the output stage 110 can include a capacitance 124 as shown. In certain embodiments, the transistor 102 can be a native transistor, a metal-oxide semiconductor field effect transistor (MOSFET), or another type of transistor. The transistor 120 can be coupled to the reference voltage 112 by its gate connection. In the illustrated embodiment, the transistor 120 is directly connected to the reference voltage 112 so that that the voltage on the gate connection is the reference voltage 112. In other embodiments, there may be other circuitry between the voltage reference circuit 108 and the output stage 110. One such embodiment is described in connection with FIG. 2. In such embodiments, the gate voltage of the transistor 120 can be based on the reference voltage 112, and may or may not be approximately equal to the reference voltage 112.

In one aspect of the invention, the output stage 110 includes a current source 122 that provides a particular current, which will be referred to herein as a "minimum current." In one embodiment, the current source 122 can be implemented based on a current mirror circuit. The current source 122 serves at least two purposes. First, the minimum current flows through the transistor 120 at all times, thereby keeping the transistor 120 on and readily conducting current. This minimum current reduces the output impedance at the source connection of the transistor 120. Therefore, when the output terminals 106 require any current, the transistor 120 can react more quickly to pass the current from the power connection 102 to the output terminals 106. Second, the minimum current configures the voltage on the source connection of the transistor 120. Those skilled in the art will recognize that when a transistor operates in saturation mode, the amount of current flowing through a transistor affects the value of a transistor's gate-to-source voltage. Because the gate voltage is set at a particular reference voltage 112, the gate-to-source voltage established by the minimum current configures the voltage at the source connection of the transistor 120.

By this operation, it can be seen that the circuit 100 may not maintain a particular DC output voltage 106. Rather, the reference voltage 112 and the current source 122 set the output voltage 106 to a particular voltage. When current is drawn by a load (not shown) through the output connection 106, the gate-to-source voltage of the transistor 120 may change. However, the gate voltage of the transistor 120 is set by the reference voltage circuit 108 and should not change. Therefore, a load current will change the voltage on the source connection of the transistor 120.

The optional capacitance 124 in the output stage operates similarly to the optional capacitance 118 of the voltage regulator circuit 108. Specifically, the capacitance 124 in the output stage provides a degree of stability.

As a numerical example of the illustrated embodiment of FIG. 1, suppose that the power connection 102 couples 3.3 volts DC to the DC output voltage circuit 100. In the reference voltage circuit 108, suppose the reference current is 100 μA (micro-amperes) and the resistance $R_2$ is 20 kΩ (kilo-ohms). As described above, the reference voltage 112 is $V_{REF}=I_{REF}\cdot R_2$, which comes out to be two volts. Therefore, the voltage on the transistor's gate connection is also two volts. In the output stage 110, suppose the transistor 120 is a native transistor. In a native transistor operating in the saturation region, the gate-to-source voltage can vary between about −0.1 volts to about +0.2 volts based on the transistor's current. In one embodiment, the minimum current from the current source 122 can be selected to configure the transistor's gate-to-source voltage to be +0.2 volts, when other current is not flowing through the transistor 120. As described above, the voltage at the source connection of the transistor 120 can be approximately equal to $(V_G-V_{GS})$, which is (2.0-0.2)=1.8 volts. Therefore, the DC output voltage circuit 100 in this example can provide a DC output voltage of 1.8 volts when only the minimum current is flowing through the transistor 120.

It can be seen that the DC output voltage circuit 100 illustrated in FIG. 1 does not suffer from the deficiencies of the existing DC output voltage circuits previously describe herein. The circuit 100 does not include a feedback path and, therefore, does not have stability issues, such as positive feedback. The circuit 100 also is not a diode-connected source-follower circuit and, therefore, does not suffer from poor PSRR at lower frequencies. As described above, PSRR is a ratio of change in voltage on the power connection 102 to a corresponding change in voltage on the output connection 106.

The PSRR of the circuit 100 results from the operation described above. In particular, the voltage on the transistor's source connection 106 does not depend upon the voltage on the power connection 102. Rather, the transistor's source voltage 106 is determined by the gate voltage 112 and the current source 122 (when there is no load current). The circuit 100 can be configured so that when the transistor 120 is operating in the saturation region, voltage variations on the power connection 102 do not affect the transistor's gate-to-source voltage and, at most, affect the transistor's drain-to-source voltage. In this case, the transistor's gate voltage and gate-to-source voltage do not vary with the power voltage 102. Therefore, this operation of the DC output voltage circuit 100 provides a degree of PSRR. In can be seen that this rejection capability is the same regardless of the frequency of variation on the power connection 102.

Therefore, the DC output voltage circuit 100 can have a substantially flat PSRR across a frequency range of interest.

Figure 2:
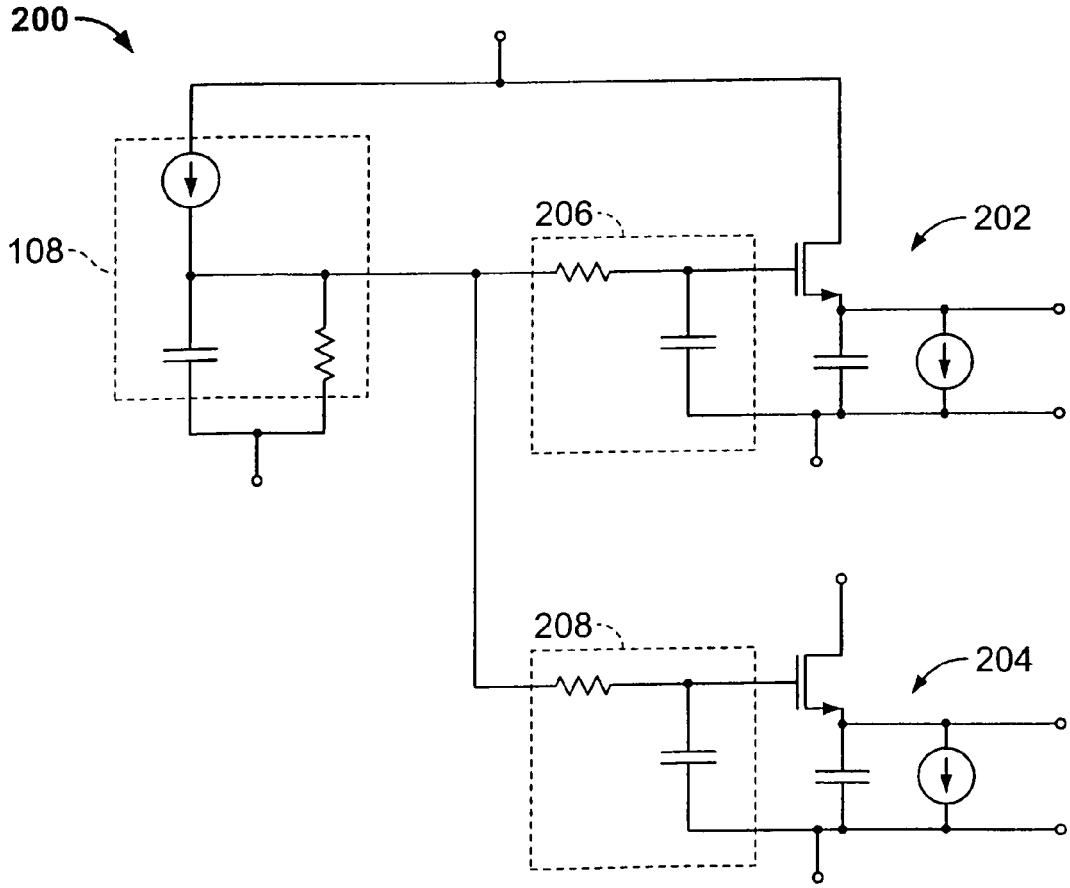
FIG. 2 is a circuit diagram of an exemplary DC output voltage circuit in accordance with another aspect of the invention.

Referring now to FIG. 2, there is shown another DC output voltage circuit 200 in accordance with another aspect of the invention. In one aspect, the reference voltage circuit 108 is coupled to two output stages 202, 204. In the illustrated embodiment, the same reference voltage is provided to the gate connections of the output stages 202, 204. Therefore, if the output stages include monolithic components that are fabricated using the same process, the output stages should behave the same way and should provide substantially equivalent output voltages. It is contemplated that, in certain embodiments, the output stages 202, 204 need not be monolithic and can behave differently. In certain embodiments (not shown), the reference voltage circuit 108 can be coupled to more than two output stages.

In one aspect of the invention, the different output stages 202, 204 can be coupled to different circuits (not shown). Some of the circuits may include noise, such as switching noise, which may be coupled to the output stages 202, 204. In accordance with one aspect of the invention, the filters 206, 208 can mitigate the coupling of noise through the DC output voltage circuit 200. The filters 206, 208 are connected to the gate connections of the transistors in the output stages. Therefore, the filters mitigate noise coupling through the gate voltages $V_G$. The filters 206, 208 are illustrated as low-pass filter, but they can be another type of filter that couples the reference voltage to the output stages. In other embodiments, the filters 206, 208 can be implemented by different types and quantities of components than those illustrated and can include multiple, cascaded filters. In other embodiments, there need not be a filter connected to each output stage. For example, only output stages that connect to noise-sensitive circuits can use a filter.

Figure 3:
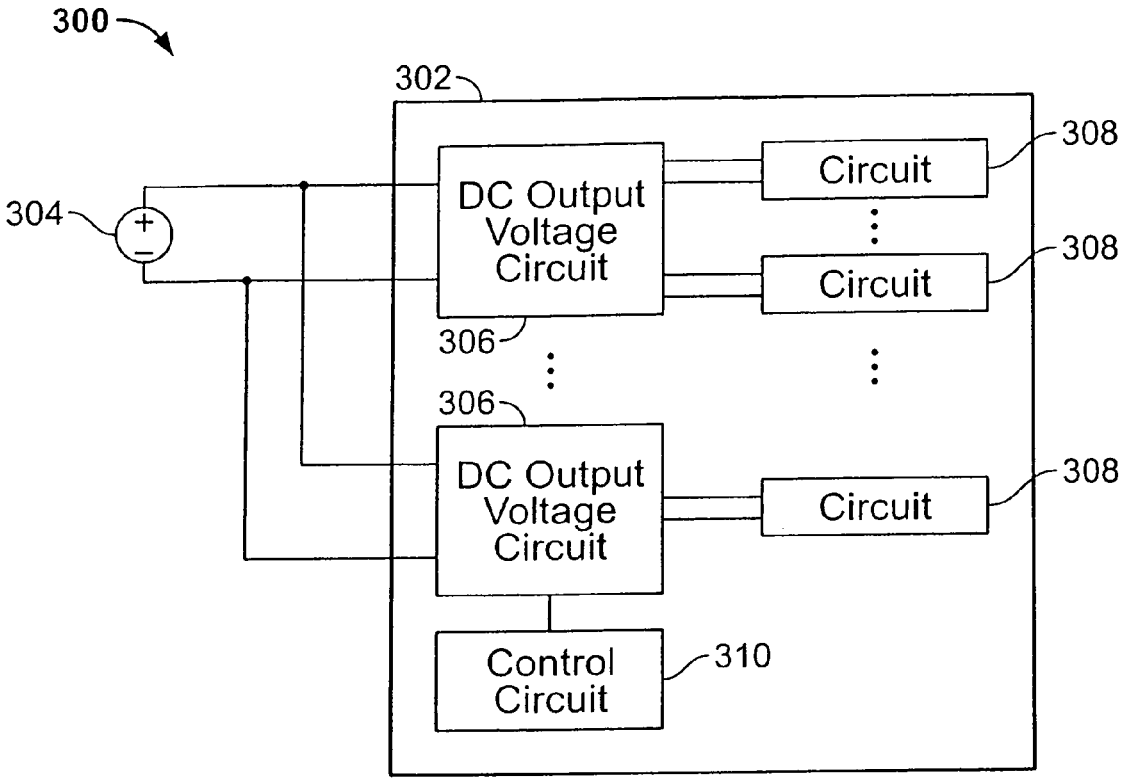
FIG. 3 is a block diagram of an exemplary system that includes a DC output voltage circuit in accordance with aspects of the invention.

Referring now to FIG. 3, there is shown a block diagram of a system that employs aspects of the invention. The system includes an integrated circuit 302 that can be coupled to a power supply 304, such as a battery. In one embodiment, the integrated circuit 302 may be a programmable logic device ("PLD") or may include a PLD (not shown). In some embodiments, the power supply 304 can be a wall outlet, and the system 300 can include AC-to-DC converters (not shown). The integrated circuit 302 can be packaged in a chip housing (not shown) and can be coupled to the power supply 304 through pins (not shown). The integrated circuit 302 can include DC output voltage circuits 306 in accordance with the embodiments of FIGS. 1-2. The DC output voltage circuits 306 can provide output voltages to other circuits 308, as described above.

In accordance with one aspect of the invention, the integrated circuit 302 can include a control circuit 310 that is coupled to the DC output voltage circuits 306. In one embodiment, the control circuit 310 can adjust the output voltages of the DC output voltage circuits 306. For example, referring also to FIG. 1, the resistance $R_2$ 116 in the reference voltage circuit 108 can be implemented by a network of resistances and switches (not shown). The control circuit 310 can programmably configure the switches to configure the value of the resistance $R_2$ 116, thereby adjusting the value of the gate voltage 112 and the value of the output voltage 106. In one embodiment, the control circuit 310 can adjust the reference resistance $R_1$ in the current source 114.

Accordingly, what has been described herein is a circuit and a system for providing a DC output voltage. It is contemplated that in certain embodiments, other circuits and components can be coupled or connected to the illustrated circuits or to portions of the illustrated circuits without altering the principles described herein. One skilled in the art will appreciate that any embodiment described and/or illustrated herein is exemplary and does not limit the scope of the invention as defined by the following claims.

What is claimed is:

1. A circuit, comprising:

a transistor having drain, source, and gate connections;

a power connection connected to the drain connection;

a current source coupled to the source connection of the transistor that causes the transistor to pass at least a minimum current, wherein the minimum current corresponds to a particular gate-to-source voltage;

a reference voltage circuit coupled to the transistor that causes a substantially constant gate voltage on the gate connection;

an output connection coupled to the source connection; and a capacitor coupled to the source connection, wherein the capacitor is operable to provide current to the output connection.

2. The circuit of claim 1, wherein the gate-to-source voltage is based on the transistor's current.

3. The circuit of claim 1, wherein:

the reference voltage circuit comprises a reference current and a resistance coupled to the reference current; and the gate voltage is based on $(I_{REF} \cdot R_2)$, where $I_{REF}$ is the reference current and $R_2$ is the resistance.

4. The circuit of claim 3, wherein the resistance is a variable resistance.

5. The circuit of claim 3, wherein:

the reference voltage circuit further comprises a reference resistance and a bandgap voltage reference circuit that provides a bandgap voltage; and the reference current is based on $$\frac{V_{BG}}{R_1},$$

where $V_{BG}$ is bandgap voltage and $R_1$ is the reference resistance.

6. The circuit of claim 5, wherein the resistance and the reference resistance are monolithic resistances produced using a common fabrication process.

7. The circuit of claim 1, further comprising a filter coupled between the reference voltage circuit and the transistor.

8. The circuit of claim 7, wherein:

the reference voltage circuit is connected to the filter; and the filter is connected to the gate connection.

9. The circuit of claim 7, wherein the filter is a low-pass filter.

10. The circuit of claim 1, further comprising:

a second transistor coupled to the reference voltage circuit and having drain, source, and gate connections, wherein:

the second transistor's drain connection is connected to the power connection, and the reference voltage circuit causes the second transistor's gate connection to have the substantially constant gate voltage; and a second current source coupled to the second transistor that causes the second transistor to pass at least a second minimum current, wherein the second minimum current corresponds to a particular gate-to-source voltage in the second transistor.

11. The circuit of claim 10, wherein the transistor and the second transistor are monolithic transistors produced using a common fabrication process.

12. The circuit of claim 11, wherein:

the minimum current and the second minimum current are substantially equal; and the transistor's gate-to-source voltage and the second transistor's gate-to-source voltage are substantially equal.

13. The circuit of claim 10, further comprising a filter coupled between the voltage reference circuit and the second transistor's gate connection.

14. The circuit of claim 10, wherein the second current source is connected to the second transistor's source connection, the circuit further comprising:

an output connection connected to the source connection; and a capacitor connected to the second transistor's source connection, wherein the capacitor is operable to provide current to the output connection.

15. The circuit of claim 10, further comprising:

a first output connection connected to the transistor's source connection; and a second output connection connected to the second transistor's source connection, where the first output connection and the second output connection are distinct.

16. A system, comprising:

a first circuit and a second circuit; and a direct-current (DC) output voltage circuit comprising:

a reference voltage circuit that provides a substantially constant reference voltage, wherein the reference voltage circuit comprises a first current source coupled to a first capacitor that is operable to minimize voltage level variations in the reference voltage;

a first output stage coupled to the reference voltage circuit and the first circuit, wherein the first output stage provides a first output voltage to the first circuit based on the reference voltage;

a second output stage coupled to the reference voltage circuit and the second circuit, wherein the second output stage provides a second output voltage to the second circuit based on the reference voltage; and a filter coupled to the first output stage, wherein the filter mitigates at least some noise coupling between the first circuit and the second circuit.

17. The system of claim 16, wherein the reference voltage circuit comprises a bandgap voltage reference circuit.

18. The system of claim 17, wherein:

the first output stage comprises a transistor having a gate connection;

the reference voltage circuit is connected to the filter; and the filter is connected to the gate connection, wherein the gate connection carries the substantially constant reference voltage.

19. The system of claim 16, further comprising a power connection, wherein:

the first output stage further comprises a second current source that passes a particular current and a transistor; and the transistor includes a drain connection connected to the power connection and a source connection connected to the second current source, wherein the particular current passes through the transistor.

20. The system of claim 16 wherein the first output voltage and the second output voltage are approximately equal.

* * * * *